United States Patent [19]

Raasch

[11] Patent Number: 4,825,631

[45] Date of Patent: May 2, 1989

[54] METHOD FOR PIECING A THREAD FORMED IN AN OPEN-END SPINNING DEVICE

[75] Inventor: Hans Raasch, Mönchengladbach, Fed. Rep. of Germany

[73] Assignee: W. Schlafhorst & Co., Mönchengladbach, Fed. Rep. of Germany

[21] Appl. No.: 66,747

[22] Filed: Jun. 22, 1987

Related U.S. Application Data

[63] Continuation-in-part of Ser. No. 889,826, Jul. 24, 1986, abandoned.

[30] Foreign Application Priority Data

May 30, 1986 [DE] Fed. Rep. of Germany ..... 3618253

[51] Int. Cl.[4] ..... D01H 15/00; D01H 11/00

[52] U.S. Cl. ..... 57/263; 57/301

[58] Field of Search ..... 57/263, 264, 301, 400, 57/401, 261

[56] References Cited

U.S. PATENT DOCUMENTS

| | | | |
|---|---|---|---|
| 4,038,812 | 8/1977 | Stahlecker | 57/301 |
| 4,249,369 | 2/1981 | Tsuzuki et al. | 57/263 |
| 4,384,451 | 5/1983 | Elias et al. | 57/301 X |
| 4,497,166 | 2/1985 | Artzt et al. | 57/263 |
| 4,539,804 | 9/1985 | Derichs | 57/263 |
| 4,539,808 | 9/1985 | Miyamoto | 57/411 |

*Primary Examiner*—Donald Watkins

*Attorney, Agent, or Firm*—Herbert L. Lerner; Laurence A. Greenberg

[57] ABSTRACT

A method for piecing a thread formed in an open-end rotary spinning machine to an end of a previously formed thread, wherein spinning fibers are fed to at least one rotating fiber collection surface, the collected spinning fibers are further transported to a thread forming station connected to the fiber collection surface, and the end of the previously formed thread is joined to the spinning fibers transported to the thread forming station as the thread end is rotated, the pieced thread being continuously withdrawn from the thread forming station while spinning fibers are being continuously fed to the fiber collection surface includes a method for piecing a thread formed in an open-end rotary spinning machine to an end of a previously formed thread, wherein spinning fibers are fed to at least one rotating fiber collection surface of a spinning rotor disposed in a closed spinning chamber under negative pressure, the collected spinning fibers are further transported to a thread forming station connected to the fiber collection surface, and the end of the previously formed thread is joined to the spinning fibers transported to the thread forming station as the thread end is rotated, the pieced thread being continuously withdrawn from the thread forming station while spinning fibers are being continuously fed to the fiber collection surface.

10 Claims, 2 Drawing Sheets

METHOD FOR PIECING A THREAD FORMED IN AN OPEN-END SPINNING DEVICE

Figure 1:
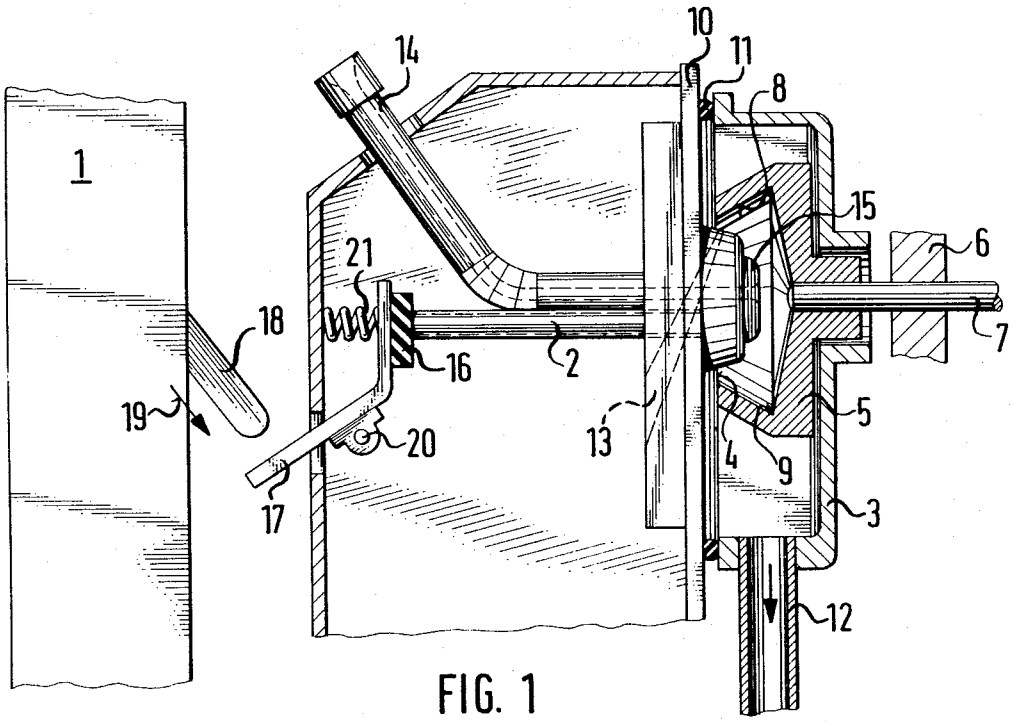

The instant application is a continuation-in-part application Ser. No. 889,826, filed July 24, 1986, now abandoned.

The invention relates to a method for piecing a thread formed in an open-end spinning device to an end of a previously formed thread and, more particularly, wherein spinning fibers are fed to at least one rotating fiber collection surface of the open-end spinning device, the spinning fibers are further transported to a thread forming station connected to the fiber collection surface, and the end of the previously formed thread is joined to the spinning fibers transported to the thread forming station as the thread end is rotated, the pieced thread being continuously withdrawn from the thread forming station while spinning fibers are being continuously fed to the fiber collection surface.

The intake of sliver in open-end spinning devices wherein fiber isolation or separation is effected by a loosening roller is halted whenever a thread break occurs, while the loosening roller continues to rotate. The so-called fiber beard lying on the loosening roller is thereby combed-out further.

If a thread formed in the open-end spinning device is then to be pieced to the end of a previously formed thread, the intake of sliver is then first started up again in order to deliver a desired quantity of fibers to the fiber collection surface so that fibers will already be present at the thread forming station for the end of the previously formed thread which has been transported back thereto.

Difficulties already result therefrom because the extent to which the fiber beard is combed out on the loosening roller depends upon how long the open-end spinning device has been stopped. Due to the fact that the combed-out fibers have been removed beforehand in the course of a cleaning operation, they are no longer available for piecing, so that the piecing device must forcibly stop at different times which generally results in quality loss or damage.

It has become known heretofore from German Pat. Nos. 25 05 943 and 24 58 042 to continue fiber intake for a predetermined time period before cleaning the rotor and, accordingly, feed in the sliver until a fiber beard with non-shortened fibers lie on the loosening roller. In the time period between the first in-feeding interval and the final feed-in, fibers are also again combed out, but because the time period for each piecing operation is the same, however, it is assumed that the amount lost is also constant. Actually, different amounts of fibers are combed out in this time period, which is about five to ten seconds.

In the case of fine threads, on which the operations are performed with great delay, this can result in piecings of varying thickness.

In a heretofore known method of yarn piecing described in U.S. Pat. No. 4,384,451 of Elias et al, short, low-quality fibers removed from a stationary fiber beard are led away from a fiber transport path between a combing roll and a rotor or, in other words, before such short, low-quality fibers reach the spinning rotor. In the improved method of the invention, however, the short, low-quality fibers removed from the fiber beard are not led away from the fiber transport path between the feeding device and the rotor, but rather, are fed into the rotor, and only then removed, or incorporated in the piecing, as the case may be.

It is accordingly an object of the invention to provide a piecing method of the foregoing general type which avoids the foregoing difficulties and assures high quality piecing of threads.

With the foregoing and other objects in view, there is provided, in accordance with one aspect of the invention, a method for piecing a thread formed in an open-end rotary spinning machine to an end of a previously formed thread, wherein spinning fibers are fed to at least one rotating fiber collection surface, the collected spinning fibers are further transported to a thread forming station connected to the fiber collection surface, and the end of the previously formed thread is joined to the spinning fibers transported to the thread forming station as the thread end is rotated, the pieced thread being continuously withdrawn from the thread forming station while spinning fibers are being continuously fed to the fiber collection surface, which comprises:

(a) braking the spinning rotor to a stop;

(b) opening the spinning chamber;

(c) cleaning the rotor;

(d) closing the spinning chamber;

(e) actuating a sliver feed roller so as to feed fibers continuously from an existing fiber beard as well as freshly supplied sliver via a combing roll and a fiber feed tube into the stopped rotor;

(f) feeding an air stream into the stopped rotor so as to generate air turbulences therein for removing from the rotor the fibers being continuously fed into the rotor;

(g) removing the fibers from the closed spinning chamber with negative pressure;

(h) stopping the sliver feed roller so as to stop the feeding of the sliver into the stopped rotor;

(i) starting rotation of the rotor and, after a given rotor speed is attained, reactuating the sliver feed roller so as to start to feed sliver into the rotating rotor having a quantity of fibers required for a piecing operation;

(j) stopping the feeding of sliver again;

(k) further increasing the speed of the rotor and, when a given further increased rotor speed for piecing is attained, again starting to feed sliver into the rotating rotor, and inserting a thread end into a groove formed in the rotor for piecing the thread; and (l) commencing spinning of the thus pieced thread.

Accordingly, fibers are available for joining or piecing as exist during continuous spinning. The invention also avoids even a brief action of the loosening roller on the stationary fiber beard, an action which occurs with conventional devices, and which can cause unevenness or non-uniformity in the fibers made ready for the piecing operation.

In accordance with another measure, the method according to the invention includes determining the time between the end of feeding of the spinning fibers and the piecing of the thread end at the thread forming station in accordance with the quantity of fibers on the fiber collection surface desired for piecing. The duration of this time is both thread- as well as machine-dependent. The thickness of the piecing or joint is able to be affected or influenced by the quantity of fibers whereby, due to the greater thickness or density of the piecing or joint as compared to that of continuously formed thread, a suitably greater quantity of fibers can be supplied by suitably establishing the time duration in order to effect an equalization in the diameter of the joined thread.

In accordance with a further measure, the method includes removing the collected spinning fibers from the thread collection surface by a controllable air current.

In accordance with an additional measure, the method includes directing the controllable air current towards at least one of the fiber collecting surface and the thread forming station.

In accordance with yet another measure, the method includes, as a result of introducing controllable air current, placing at least the immediate surroundings of the rotating fiber collection surface under vacuum or negative pressure by means of a suction device, conducting air under normal pressure against the fiber-bearing current, and sucking away fibers and air.

In accordance with an alternate measure, the method includes, as a result of introducing the controllable air current, conducting air under excess pressure against the fiber-bearing current and blowing or sucking away fiber and air from the fiber collection surface.

In accordance with a further measure of the invention, the method includes controlling the air current by a controllable blocking or deflecting device.

In accordance with an alternate measure of the invention, the sliver feed into the rotor is stopped automatically by a thread break; the spinning chamber is opened by a travelling device causing the braking of the rotor automatically; the rotor is cleaned and the spinning chamber is closed by the travelling device while the rotor remains stopped; the air stream is fed into the stopped rotor by coupling a feeding drive of a piecing carriage with a sliver feeding device of the spinning station and opening a piecing valve from an air supply; the sliver feed is restarted by the piecing carriage and is maintained until a sliver of given length is fed in without depositing any fibers in the rotor; just before the piecing speed is attained by the rotor, again starting to feed the sliver for a second time; after which the sliver feed is again stopped, at which the quantity of fibers required for the piecing operation is received by the rotor and remains in the rotor due to centrifugal force; the thread end is inserted into the rotor groove by the piecing carriage to piece the thread; the piecing carriage then starts the fiber feed for a third time and, thereafter, the thread withdrawal for the final spinning operation and the sliver feeding speed and thread withdrawal speed running together with the rotor at operating speed; the sliver feed at the spinning station is stopped and the sliver feed at the side of the piecing carriage is withdrawn; and closing the piecing valve and transferring the thread from the withdrawing device of the piecing carriage to a withdrawing device of the spinning station to terminate the piecing operation so as to permit the piecing carriage to travel to a different operating location.

In accordance with an concomitant measure of the invention after the sliver feed has ben stopped by a thread break, the piecing operation takes place in the following sequence at the piecing carriage:

(a) opening the spinning chamber and thereby braking the rotor;

(b) cleaning the rotor;

(c) closing the spinning chamber;

(d) applying the feeding drive by the piecing carriage and opening the piecing valve;

(e) switching on the sliver feed so as to feed in a sliver length of 25 to 60 mm in a time period of approximately 1.27 s (EI);

(f) pausing approximately 3.7 s;

(g) starting up the rotor;

(h) measuring the rotor speed and calculating the time until the rotor operating speed is reached;

(i) starting sliver feed (E II) approximately 600 ms before the rotor has reached piecing speed;

(j) stopping sliver feed after approximately 230 ms;

(k) inserting the thread end into the rotor;

(l) starting sliver feed approximately 90 ms before thread withdrawal (E III);

(m) starting thread withdrawal for piecing;

(n) feeding the sliver and withdrawing the thread at the speed of the rotor up to operating speed;

(o) switching on sliver feed at the spinning station side; and (p) disengaging the drive for sliver feed of the piecing carriage and closing the piecing valve.

Other measures or features which are considered as characteristic for the invention are set forth in the appended claims.

Although the invention is illustrated and described herein as a method for piecing a thread formed in an open-end spinning device to the end of a previously formed thread, it is nevertheless not intended to be limited to the details shown, since various modifications may be made therein without departing from the spirit of the invention and within the scope and range of equivalents of the claims.

The method of the invention, however, together with additional objects and advantages thereof will be best understood from the following description of specific measures when read in connection with the accompanying drawing in which:

FIG. 1 is a fragmentary, vertical sectional view of a thread piecing or joining device according to the invention; and FIGS. *2a*, *2b* and *2c* are plot diagrams of parameters of the piecing operation with respect to time.

Referring now to FIG. 1 of the drawing, there is shown therein a piecing device 1 on an open-end rotary spinning machine. Part of the piecing device 1, in addition to its conventional function, cooperates with an air feed channel 2, in a manner described hereinafter, during the piecing operation. The air feed channel 2 terminates in a housing 3 subject to vacuum or negative pressure and, indeed, in vicinity of an end opening 4 of a rotor 5 of the spinning machine. The rotor 5 is mounted by a shaft 7 thereof via a suitable bearing 6 in the spinning machine. The rotor 5 is formed with a conventional fiber collection surface 8 and a rotor groove 9. In the illustrated embodiment, the housing 3 is closed by a cover 10 which is pressed via a seal against the housing 3 by non-illustrated conventional means. Air-tight closure of the housing 3 is effected thereby, the latter being, in addition, connected via a suction line 12 to a vacuum or negative pressure system. A fiber supply channel 13 is formed in the cover 10 for supplying fibers coming from a fiber loosening device to the rotor 5. The cover 10 is, moreover, penetrated by a fiber withdrawal tube which terminates in a withdrawal nozzle 15.

The air feed channel 2 is kept closed during the spinning operation by a sealing plate 16 and a spring-loaded lever 17. During the piecing operation, a lever 18 is pushed out of the piecing device 1 in the direction of the arrow 19 and moves the lever 17 about a pivot point 20 opposite the force of a spring 21. Air at atmospheric pressure thereby has access to the air feed channel 2. The air flows into the interior of the housing 3 and the rotor 5, respectively, which are under vacuum or negative pressure, and turbulently whirls the fibers fed through the fiber supply channel 13 around therein. The fibers thus cannot deposit on the collecting surface 8 and slide into the rotor groove 9 and are removed via the suction line or discharge tube 12 due to the vacuum or negative pressure therein. In accordance with a prescribed, conventionally provided timing program, the supplying of fibers, the returning of the thread end through the fiber withdrawal channel 14 and the opening and closing of the air feed channel 2 are so controlled that the quantity of fibers necessary for forming a good thread piece for the piecing or joining operation is available in the rotor groove 9. The supply channel can terminate in a different manner in the housing 3 and in the opening region of the rotor 5, respectively, an air current of adequate size having to be guided in such a way that the fibers can be predeterminately removed or left in the rotor.

Analogously, the invention which has been described with respect to FIG. 1 in relation to an open-end rotary spinning machine, may be used as well in conjunction with a friction-type spinning machine.

Figures 2A, 2B, 2C:
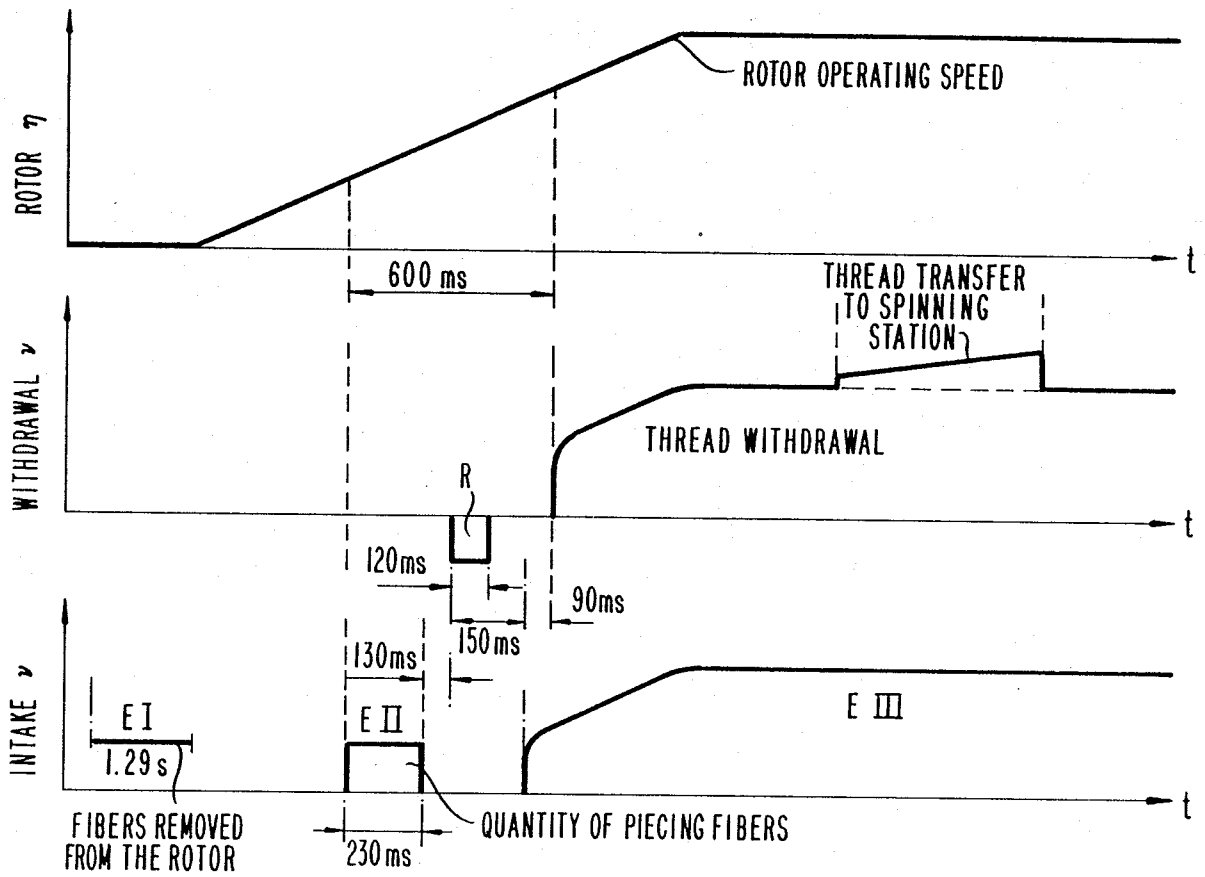

FIGS. 2*a*, 2*b* and 2*c* are respective plot diagrams of the rotor speed, the thread withdrawal velocity or return velocity of the thread end being pieced or joined, and the fiber intake or feeding velocity, all shown at the same time scale along the abscissa.

In FIG. 2*a*, it is noted that approximately 600 milliseconds elapse between the rotor speed shown by a first circle at which fiber advance feed or advance intake is started, and the rotor speed shown by a second circle at which fiber feed or intake proper is started.

In FIG. 2*b*, the thread return R for approximately 120 ms is represented, and it is apparent that there is a short pause between the end of the return R and the beginning of the thread withdrawal, the latter beginning simultaneously with the fiber feed or intake proper. Thread transfer to the spinning station is also shown in FIG. 2*b*.

In FIG. 2*c*, the fiber advance intake or feed occurs in three phases EI, EII and EIII. In phase EI, a sliver length of 25 to 60 mm is fed into the rotor during a period of approximately 1.27 s and a pause of approximately 3.7 s occurs before start-up of the rotor. In phase EII, sliver feed is started again approximately 600 ms before piecing speed is attained, and is stopped after approximately 230 ms. In phase EIII, sliver feed is again started approximately 90 ms before thread withdrawal. For a more detailed description of the piecing carriage and spinning station referred to herein, reference may be had to U.S. Pat. No. 4,120,140. Reference may also be made to U.S. Pat. No. 4,102,116 for further details of the plot diagrams shown in FIGS. 2*a*, 2*b* and 2*c*.

I claim:

1. Method for piecing a thread formed in an open-end rotary spinning machine to an end of a previously formed thread, wherein spinning fibers are fed to at least one rotating fiber collection surface of a spinning rotor disposed in a closed spinning chamber under negative pressure, the collected spinning fibers are further transported to a thread forming station connected to the fiber collection surface, and the end of the previously formed thread is joined to the spinning fibers transported to the thread forming station as the thread end is rotated, the pieced thread being continuously withdrawn from the thread forming station while spinning fibers are being continuously fed to the fiber collection surface, which comprises:

(a) braking the spinning rotor to a stop;
(b) opening the spinning chamber;
(c) cleaning the rotor;
(d) closing the spinning chamber;
(e) actuating a sliver feed roller so as to feed fibers continuously from an existing fiber beard as well as freshly supplied sliver via a combing roll and a fiber feed tube into the stopped rotor;
(f) feeding an air stream into the stopped rotor so as to generate air turbulences therein for removing from the rotor the fibers being continuously fed into the rotor;
(g) removing the fibers from the closed spinning chamber with negative pressure;
(h) stopping the sliver feed roller so as to stop the feeding of the sliver into the stopped rotor;
(i) starting rotation of the rotor and, after a given rotor speed is attained, reactuating the sliver feed roller so as to start to feed sliver into the rotating rotor having a quantity of fibers required for a piecing operation;
(j) stopping the feeding of sliver again;
(k) further increasing the speed of the rotor and, when a given further increased rotor speed for piecing is attained, again starting to feed sliver into the rotating rotor, and inserting a thread end into a groove formed in the rotor for piecing the thread; and
(l) commencing spinning of the thus pieced thread.

2. Method according to claim 1, which includes determining the time between the end of feeding of the spinning fibers and the piecing of the thread end at the thread forming station in accordance with the quantity of fibers on the fiber collection surface desired for piecing.

3. Method according to claim 1, which includes removing the collected spinning fibers from the thread collection surface by a controllable air current.

4. Method according to claim 3, which includes directing the controllable air current towards at least one of the fiber collecting surface and the thread forming station.

5. Method according to claim 3, which includes, as a result of introducing controllable air current, placing at least the immediate surroundings of the rotating fiber collection surface under vacuum or negative pressure by means of a suction device, conducting air under normal pressure against the fiber-bearing current, and sucking away fibers and air.

6. Method according to claim 3, which includes, as a result of introducing the controllable air current, conducting air under excess pressure against the fiber-bearing current and blowing or sucking away fiber and air from the fiber collection surface.

7. Method according to claim 1, which includes controlling the air current by a controllable blocking device.

8. Method according to claim 1, which includes controlling the air current by a controllable deflecting device.

9. Method according to claim 1, wherein the sliver feed into the rotor is stopped automatically by a thread break; the spinning chamber is opened by a travelling device causing the braking of the rotor automatically; the rotor is cleaned and the spinning chamber is closed by the travelling device while the rotor remains stopped; the air stream is fed into the stopped rotor by coupling a feeding drive of a piecing carriage with a sliver feeding device of the spinning station and opening a piecing valve from an air supply; the sliver feed is restarted by the piecing carriage and is maintained until a sliver of given length is fed in without depositing any fibers in the rotor; just before the piecing speed is attained by the rotor, again starting to feed the sliver for a second time; after which the sliver feed is again stopped, at which the quantity of fibers required for the piecing operation is received by the rotor and remains in the rotor due to centrifugal force; the thread end is inserted into the rotor groove by the piecing carriage to piece the thread; the piecing carriage then starts the fiber feed for a third time and, thereafter, the thread withdrawal for the final spinning operation and the sliver feeding speed and thread withdrawal speed running together with the rotor at operating speed; the sliver feed at the spinning station is stopped and the sliver feed at the side of the piecing carriage is withdrawn; and closing the piecing valve and transferring the thread from the withdrawing device of the piecing carriage to a withdrawing device of the spinning station to terminate the piecing operation so as to permit the piecing carriage to travel to a different operating location.

10. Method according to claim 9, wherein after the sliver feed has been stopped by a thread break, the piecing operation takes place in the following sequence at the piecing carriage:

(a) opening the spinning chamber and thereby braking the rotor;
(b) cleaning the rotor;
(c) closing the spinning chamber;
(d) applying the feeding drive by the piecing carriage and opening the piecing valve;
(e) switching on the sliver feed so as to feed in a sliver length of 25 to 60 mm in a time period of approximately 1.27 s (EI);
(f) pausing approximately 3.7 s;
(g) starting up the rotor;
(h) measuring the rotor speed and calculating the time until the rotor operating speed is reached;
(i) starting sliver feed (E II) approximately 600 ms before the rotor has reached piecing speed;
(j) stopping sliver feed after approximately 230 ms;
(k) inserting the thread end into the rotor;
(l) starting sliver feed approximately 90 ms before thread withdrawal (E III);
(m) starting thread withdrawal for piecing;
(n) feeding the sliver and withdrawing the thread at the speed of the rotor up to operating speed;
(o) switching on sliver feed at the spinning station side; and
(p) disengaging the drive for sliver feed of the piecing carriage and closing the piecing valve.

* * * * *